United States Patent [19]

Chang

[11] Patent Number: 4,748,828

[45] Date of Patent: Jun. 7, 1988

[54] SELF-DRAINING BASE PAN FOR AN AIR CONDITIONER

[75] Inventor: Dick Y. K. Chang, Indianapolis, Ind.

[73] Assignee: Carrier Corporation, Syracuse, N.Y.

[21] Appl. No.: 67,350

[22] Filed: Jun. 29, 1987

[51] Int. Cl.[4] ..... F25D 21/14

[52] U.S. Cl. ..... 62/290; 62/272

[58] Field of Search ..... 62/272, 295, 297, 507, 62/298, 281, 285, 290

[56] References Cited

U.S. PATENT DOCUMENTS 3,040,543 6/1962 Atchison ..... 62/262

*Primary Examiner*—Henry A. Bennet

*Attorney, Agent, or Firm*—Dana F. Bigelow

[57] ABSTRACT

The base pan of a heat pump has a plurality of drainage openings formed near the periphery thereof such that either a single row coil or a multiple row coil heat exchanger may be used therewith to obtain adequate drainage of defrost liquid while at the same time preventing any downward movement of molten metal or hot particles through the drainage openings. The openings are located directly under the single or outside coil and a slanted shelf is placed directly under the location where the inner coil(s) would be placed, with the slanted shelf acting as a barrier for hot materials in a single coil apparatus and as a conduit for drainage to the opening when used with a multiple coil apparatus.

5 Claims, 3 Drawing Sheets

SELF-DRAINING BASE PAN FOR AN AIR CONDITIONER

BACKGROUND OF THE INVENTION

This invention relates generally to air conditioning systems and more particularly to an air conditioner base pan with drainage features that can be used with either single row or multiple row coil applications.

An inherent operating characteristic of a heat pump is the need to operate in a defrost mode for short periods of time to thereby remove the frost which has formed on the outdoor coil during operation in the heating mode. This is accomplished by reversing the system to operate in the cooling mode such that the outdoor coil gives off heat to thereby melt the formed ice. Upon melting the ice, the resulting water must be disposed of quickly before it freezes and plugs up the drainage system.

Traditionally, the melted ice has flowed from the coils to a base pan below, from which it drained through a plurality of holes or slots formed in the base pan for that purpose. The size of the drainage holes or slots was determined by the number of coil rows, with a multiple row coil requiring substantially larger openings than a single row coil for proper drainage.

For proper drainage, it should also be recognized that the base pan will be susceptible to the buildup of dirt and debris if the drainage openings are too small. Any accumulation of such material will not only impede the proper flow of liquid, but it will also tend to bridge the gap between the steel base pan and the aluminum coil to thereby cause electrolytic action between the two.

As a safeguard against the possibility of a fire being started from a spark or from molten metal that might be produced by the fan motor, the UL requirements for air conditioners have required that there be no openings in the bottom of an air conditioning structure which are directly below the electrical devices or wiring that may give off hot particles such as sparks or molten metal. Thus, it will be understood that the drainage holes must be located and sized in such a way as to avoid this exposure. If one is designing a base pan specifically for a single row coil or specifically for a multiple row coil, the drainage hole size and location can accordingly be chosen to accommodate that design. However, where one wishes to provide a single base pan design which can be used for either single or multiple coil use, then the above safeguard requirements, together with the requirements for proper drainage, become a problem.

It is therefore an object of the present invention to provide an improved base pan drainage system for heat pumps.

Another object of the present invention is the provision for a single base pan design which can be used with either single row or multiple row coils.

Yet another object of the present invention is the provision for a base pan drainage structure which is not directly exposed to the fan motor and associated wiring but which provides adequate drainage for either single or multiple row coils.

Still another object of the present invention is the provision for a self-draining base pan which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, a base pan is formed with a plurality of drainage shelves disposed around its periphery just below where the coil(s) would be mounted. Also formed in the base pan, in direct drainage communication below, but radially offset from, the shelves, are openings through which water can be drained from the base pan. The size and location of the openings are such that either a single row coil or a multiple row coil can be mounted on the base pan without jeopardizing either the adequacy of the drainage system or the safeguard against exposure to hot particles emanating from the electrical apparatus mounted at a location within the coils. The location of the single row coil, or of the outer row coil in a multiple coil arrangement, is directly above the openings such that the water dripping therefrom can flow directly out through the opening, but the openings themselves are hidden from direct exposure to the electrical wiring and components by the coil. The inner row coils of a multiple coil arrangement is located over the shelf such that melted ice therefrom can drip onto the shelf and then flow to the opening where it is discharged.

In accordance with another aspect of the invention, the drainage shelves are integrally formed with the base pan and comprise both a vertically extending trough forming portion disposed directly below the location for the inner row coil, and an associated radially outwardly, and downwardly, extending portion which receives the defrosted liquid from the inner coil(s) and directs it to the discharge openings.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
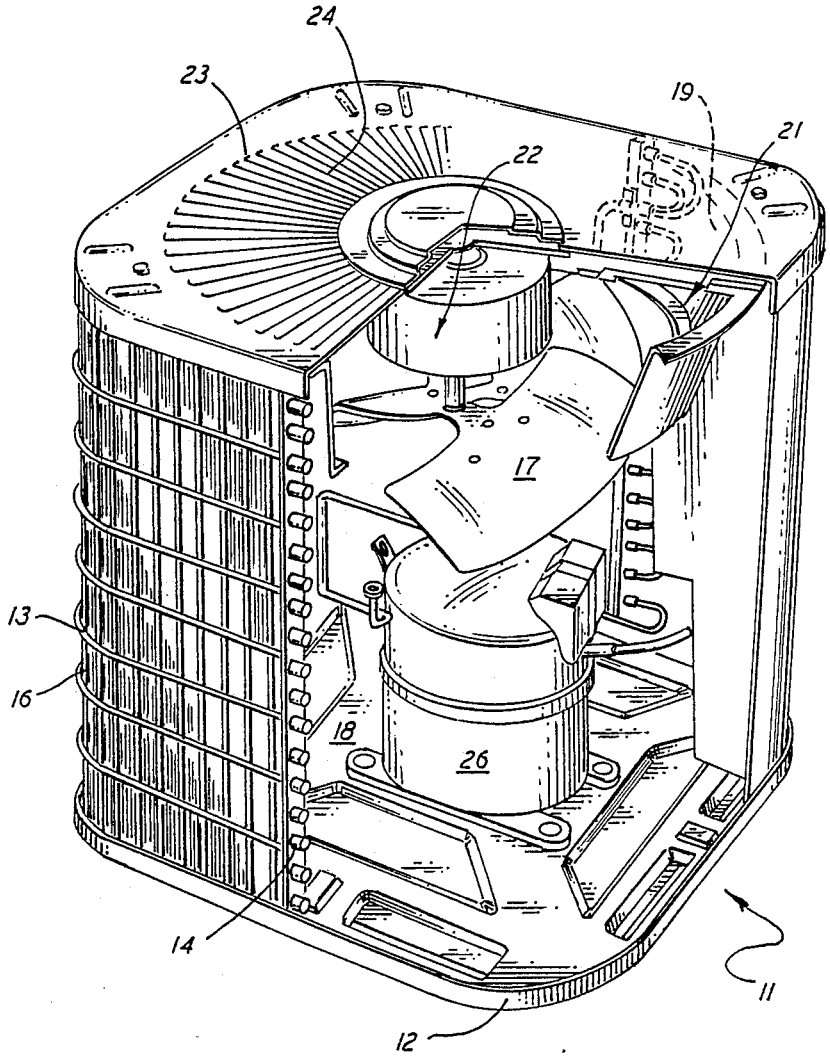
FIG. 1 is a perspective view of an air conditioning unit with a base pan in accordance with the present invention.

Referring now to FIG. 1, the present invention is shown generally at 11 as incorporated in a base pan 12 of a typical condensing unit 13 of an air conditioning or heat pump system having an indoor coil connected thereto by way of refrigerant piping.

The condensing unit 13 includes an upstanding coil 14 which together with its outer protective grille 16 defines the shape of the unit. Although the particular unit shown is generally square in shape, the coil and supporting base pan can just as well be round, or any other desirable shape, while remaining within the scope of the present invention. The coil 14 functions as a condenser coil to give up heat to the surrounding air during the periods in which the heat pump is operating in the cooling or defrost modes, while it functions as an evaporator coil to extract heat from the surrounding air during periods when the system is operating in a heating mode.

In order to promote the flow of air through the coil 14, a fan 17 is axially mounted at the top of the cavity 18 formed by the coil 14. Mounted around the fan 17 is an orifice ring 19 which defines an outwardly expanding orifice 21 to conduct the outward flow of air. Thus, as the fan 17 is driven by an electric motor 22 it draws the air into the coil 14 and out through the orifice 21. A cover 23 with a louvered opening 24 is mounted on the top of the unit for purposes of protection and support.

Also mounted in the cavity 18 is a compressor 26 and the various valves and piping necessary to fluidly connect it to both the indoor and outdoor coils. The compressor 26 is mounted to and supported by the base pan 12 as shown.

Figure 2:
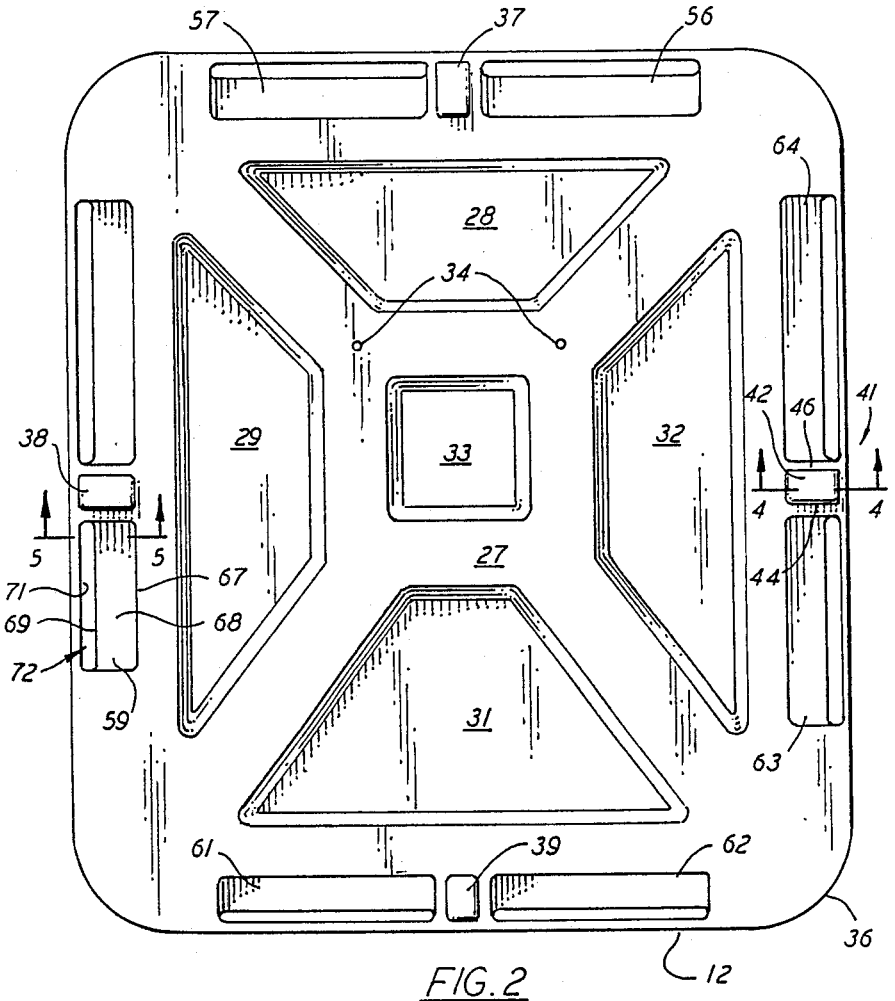
FIG. 2 is a top plan view of the base pan portion thereof.
Figure 3:
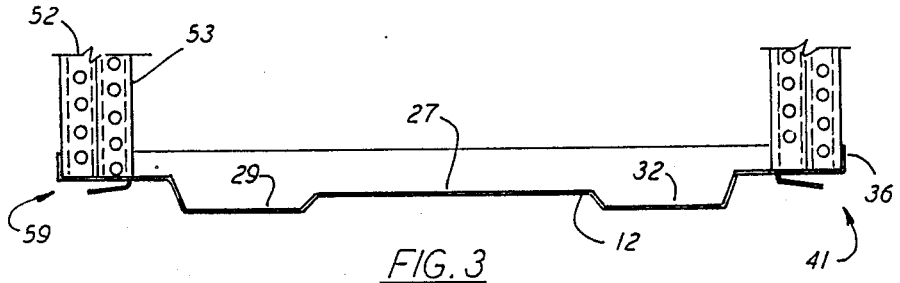
FIG. 3 is a front elevational view of the base pan portion thereof.

Referring now to FIGS. 2 and 3, the base pan 12 is shown as formed from a single piece of sheet metal with portions being deformed or stamped therein. The principal surface of the base pan is indicated at 27 and is at a raised or intermediate elevational level, whereas a plurality of lowered or depressed surfaces are provided at 28, 29, 31, 32 and 33 for the purpose of strengthening the base pan structure. Provision is made for centrally mounting the compressor 26 with bolts secured in the openings 34. An upstanding skirt 36 extends upwardly from the principal surface 27 and forms the outer perimeter of the base pan 12. Located proximate the midpoint of each side of the base pan 12 are the coil support structures as indicated at 37, 38, 39 and 41, respectively. The details of those structures are more clearly seen by reference to FIG. 4.

Figure 4:
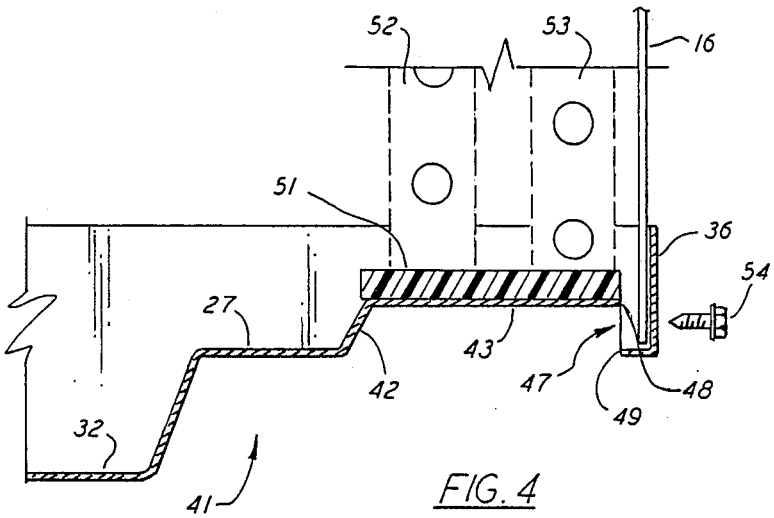
FIG. 4 is a sectional view of the coil support portion thereof as seen along lines IV—IV. of FIG. 2.

Referring to FIG. 4, it will be seen that, as the base pan extends outwardly toward the upstanding skirt 36, the profile raises from the lowered surface 32 to the principal surface 27 and then to the coil support structure 41 which includes the gradually rising inner wall 42 and a substantially horizontal pedestal surface 43. In addition to the gradually rising inner wall 42, the coil support structure 41 also includes the gradually rising side walls 44 and 46 as shown in FIG. 2. The entire coil support structure 41 is therefore integrally formed as part of the base pan structure with the pedestal surface 43 being supported on three of its sides. On the outer side thereof, an opening 47 is formed between the shelf end 48 and the exposed end 49 of that portion of the principal surface 27 extending inwardly from the upstanding skirt 36. Mounted on the horizontal pedestal surface is a nonmetallic pad 51 which is preferably attached thereto by way of an adhesive or the like. The integral horizontal pedestal surface 43, and the nonmetallic pad 51 then form the support structure for the entire vertical load of the inner row coil 52 and outer row coil 53 on that side of the unit. The coil support structures 37, 38 and 39 are identical to the coil support structure 41 as just described.

As mentioned hereinabove, a protective grille 16 surrounds the coil 14 and forms the outer boundary of the unit. This grille 16 is normally disposed with its lower end inside the upstanding skirt 36 as shown and is secured within that skirt by way of a plurality of fasteners 54. If the outer row coil 53 were permitted to rest on the base pan at the level of the principal surface 27, it then would be susceptible to being damaged by the fasteners 54 when they are inserted inwardly. However, the raised horizontal pedestal surface 43 elevates the outer row coil 53 to a height which is above the level in which the fasteners 54 are installed and thus out of the zone in which damage could occur to them. With the outer coil 53 being raised, the fasteners may be installed at any location around the periphery of the skirt 36. However, since the coil 53 will have a tendency to sag between adjacent supports, and may well sag to the point where it could be punctured by a fastener 54, the fasteners 54 are preferably installed only at the locations corresponding to those of the supports (i.e. at the openings 47) such that they will always be below the coil 53.

As mentioned hereinabove, when the unit is operating in the defrost mode, the heated refrigerant in the coil 14 functions to melt the frost that is formed thereon. As this frost is melted, it is necessary to dispose of the resulting water. Thus, a plurality of drainage openings, indicated at 56–64 in FIG. 2, are provided. Although there are two such drainage openings on each side of the base pan as shown in FIG. 2, it should be understood that drainage openings of other shapes, locations, configurations and sizes may be employed while remaining within the scope of the present invention. The particular structure of the drainage opening 59 in accordance with the present invention, and as representative of the other openings, is shown in FIG. 5.

Figure 5:
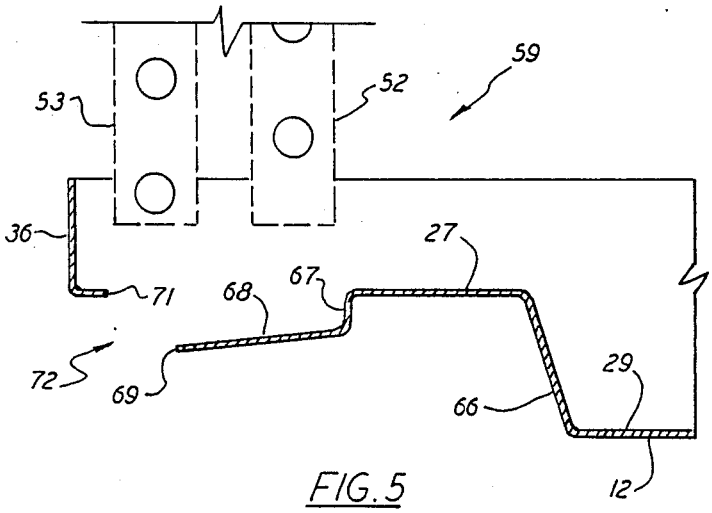
FIG. 5 is a sectional view of the drainage opening portion thereof as seen along lines V—V of FIG. 2.

Referring now to FIG. 5, as the profile of the base pan 12 extends radially outwardly, the lowered surface 29 transitions to a rising surface 66 and then to the principal surface 27. That surface then transitions to a stepped down surface 67 which extends downwardly to a slanted shelf 68. The end 69 of the shelf 68, together with the end 71 of that portion of the principal surface 27 extending inwardly from the upstanding skirt 36, define an opening 72 for drainage of the water resulting from defrosting of the coils. Such a drainage opening can be used with either a single or a dual coil installation to obtain adequate drainage while at the same time preventing any sparks or hot metal from passing through the opening. For example, in a single coil installation, the single coil would be located in the position of the outer coil 53 as shown in FIG. 5. Since the coil is located directly over the opening 72, the water will drip directly from the coil to the opening 72. For purposes of protection against the downward movement of hot materials, the coil 53 and the slanted shelf 68 serve to provide a barrier against the hot materials that could fall directly through the opening 72. In a multiple coil application, the outer coil 53 is located in the same position and performs in the same manner as described hereinabove. The inner coil 52 is now located over the slanted shelf 68 such that the residue from defrost can drip directly onto the shelf 68 and then run down to the opening 72. Again, the coils 52 and 53, together with the slanted shelf 68 tend to act as a barrier against the downward movement of hot materials.

While the present invetnion has been described with particular reference to a preferred embodiment, the concepts of the invention are readily adaptable to other embodiments, and those skilled in the art may vary the structure thereof without departing from the essential spirit of the present invention.

What is claimed is:

1. In an outdoor air conditioning apparatus of the type having a motor driven fan with associated electrical wiring and apparatus which may be susceptible to emitting hot particles therefrom, and at least one heat exchanger coil which is susceptible to the formation of liquid thereon during certain periods of operation, an improved base pan structure comprising:

a base pan with a generally flat bottom and upstanding sides at its periphery, for placement under the air conditioning apparatus with the coil near said periphery thereof;

support means associated with said base pan for providing vertical support for either one or multiple coils; and drainage means integrally formed with said base pan and comprising at least one shelf formed in said base pan at a position generally below the coil, and an opening formed in said base pan bottom and communicating with said at least one shelf, said opening being sufficiently large to accommodate liquid drainage from multiple coils while at the same time being small enough that when a single coil is used, said single coil and said shelf provide a barrier between said opening and the electrical apparatus to prevent the downward flow of hot particles through said opening.

2. An improved base pan as set forth in claim 1 wherein said shelf is formed with a vertical portion below the inner side of the inner coil to thereby form a trough.

3. An improved base pan as set forth in claim 1 wherein said shelf has a sloped portion leading to said opening.

4. In a heat pump apparatus of the type having at least one heat exchanger coil and provision for another coil to be radially displaced therein, with said coil(s) requiring occasional defrost, and electrical apparatus within the coil(s) which may be susceptible to emitting hot particles therefrom, an improved base pan structure comprising:

a base pan located under said coil(s) and said electrical apparatus, said base pan having a plurality of openings formed therein, said openings being located directly under said at least one coil to permit the defrosted liquid to drain off the coil and through said openings, and said pan also having a plurality of slanted shelves that extend substantially radially outwardly to respective ones of said openings, and means for mounting said other coil directly over said slanted shelf to permit the defrosted liquid to drain off said other coil to said slanted shelf and through said opening without the hot particles falling through said opening.

5. An improved base pan structure as set forth in claim 4 wherein said slanted shelf is integrally formed with the base pan.

* * * * *